United States Patent [19]

Moyer et al.

[11] 4,413,580

[45] Nov. 8, 1983

[54] METHOD FOR FORMING FABRIC TUBES

[75] Inventors: James D. Moyer; Robert S. Hoffert, both of Winchester, Va.

[73] Assignee: Midwestco, Inc., Niles, Ill.

[21] Appl. No.: 268,634

[22] Filed: May 29, 1981

Related U.S. Application Data

[62] Division of Ser. No. 86,141, Oct. 18, 1979.

[51] Int. Cl.[3] ..... D05B 97/00

[52] U.S. Cl. ..... 112/262.2

[58] Field of Search ..... 112/262.2, 262.1, 10, 112/63, 130, 131, 121.11, 121.12, 307, 121.15; 83/678, 695

[56] References Cited

U.S. PATENT DOCUMENTS

| | | | |
|---|---|---|---|
| 769,453 | 9/1904 | Ames | 112/10 |
| 978,481 | 12/1910 | Pelham | 112/63 |
| 2,347,901 | 5/1944 | Gardner et al. | 112/63 |
| 3,052,197 | 9/1962 | Judelson | 112/63 |
| 3,611,961 | 10/1971 | Lopez et al. | 112/121.11 |
| 3,759,198 | 9/1973 | Pisani | 112/63 |
| 4,215,606 | 8/1980 | Britt | 83/695 X |

*Primary Examiner*—H. Hampton Hunter

*Attorney, Agent, or Firm*—Brisebois & Kruger

[57] ABSTRACT

A web of fabric material is fed flat along a substantially horizontal table. The web is continuous and is marked and then partly cut just short of its edges while in the feeding plane. The edges of the web are then gripped, moved together, and overlapped as the web is moving, and the edges are sewn. A moving gripper pulls the web through the apparatus to an off the arm sewing machine, and a puller roll downstream of the sewing machine assists pulling of the web and maintains the seam tensioned during sewing.

12 Claims, 24 Drawing Figures

METHOD FOR FORMING FABRIC TUBES

This is a division of application Ser. No. 086,141, filed Oct. 18, 1979.

BACKGROUND OF THE INVENTION

This invention relates to methods and apparatus for forming fabric tubes, and more particularly relates to methods and apparatus for rapidly and accurately manufacturing tubular filter bags from a web of material.

Numerous air filtration systems include therein filter bags of felt or woven fabric material which function to remove solids from the air passing therethrough. Such bags take the form of tubes usually open at both ends may be of the outside-in or inside-out type depending upon the direction of flow of the influent solid-laden air therethrough. Thus, in the outside-in type of bag, the influent flows from outside the bag where solids are retained and the clean effluent air is removed from within the bags. The direction is reversed in the inside-out type of bag and solid laden influent is fed to the inside of the bag and the solids in the air are retained inside the bag. In this type, the clean effluent air is removed from the region exterior to the bag.

Such filter bags have met with great success in systems for industrial purification of air, as well as in commercial operations. In any event, in these systems, it is common to employ the bags in a unit that may contain twenty to thirty of the bags operating in parallel and connected to a common manifold.

The diameter and length of each bag, whether used singly or in combination with other bags in a manifold system, varies depending upon the particular use to which the bag is to be put and the requirements of the system into which its installation is contemplated.

In any event, it has been the practice in the past, to form such bags by hand methods and with the expenditure of substantial amounts of manual labor. Thus, it has not been uncommon to precut material into sheets by hand using common scissors. These precut sheets have then been hand manipulated to overlap the edges as the material is manually fed into a sewing machine for a tube with a seam along one side.

Filter bags today are formed from various materials such as natural and man made fibers, as well as felt. Natural fibers in general can be readily handled by operators sewing filter bags. However, fiberglass in particular, and certain weaves of polyester and acrylic are not only difficult to handle, but are somewhat abrasive and are found to injure the hands of the operators. Correspondingly, while such hand methods have in the past been used in the manufacture of filter bags of various synthetic materials, such methods have suffered from the disadvantage that those required to handle and manipulate certain synthetic materials, for example, fiberglass, are injured as a result of the nature of the material. Thus, it was not uncommon at the end of a work day for the hands of the operators to be swollen and bloody from abrasions and the numerous pricks received in handling the glass fiber sheets.

These disadvantages of the prior art are overcome with the present invention and commercially acceptable embodiments of a fabric tube former and the like are herein provided which are not only fully capable of fashioning filter bags under most operating conditions but which are also fully capable of other tasks completely beyond the capabilities of the methods and devices of the prior art. More particularly, however, the embodiments of the present invention are capable of operation with a much higher efficiency and accuracy and at a substantially reduced operating cost.

SUMMARY OF THE INVENTION

This invention is for an improved apparatus for manufacturing tubular articles from a flat moving web of material, and more particularly relates to fashioning of air filter bags or tubes from synthetic fiber materials. A roll of the material is mounted on a guide carriage at one end of a feed table. The sheet passes first to a marker having an elongated rib like wick that applies an ink line across the sheet. A cutter wheel cuts the web to the proper length, and then the at least partially precut sheet is formed into a tube and sewn to form the tube.

In one particularly ideal embodiment of the present invention, the marker is located below the sheet and has a felt rib along its top to apply ink to the sheet from a well within the marker. It is also possible to locate the marker above the sheet, but in either case it is moved to and fro with respect to the sheet by a pneumatic type of cylinder and crank arrangement. The marker is a "flying marker", and applies a line across the width of the sheet as the sheet is moving. Such lines provide guide lines for subsequent forming of cuffs, and sewing of reinforcing hoops to the bags.

In a particularly ideal embodiment of the present invention, the continuous web is precut but only between the edges leaving uncut edge portions to be later snipped after the tube is sewn. An air operated cylinder traverses a cutter wheel across the width of the sheet while a fabric clamp holds the web along each side of the cut line. The cutter roller is inoperative at each edge for a small distance to leave adjacent each edge of the sheet a small uncut portion, and when sewn, the tubes may be drawn off assembly line fashion and separated by snipping through the sewn seam and the uncut portion of each individual tube.

In a further particularly ideal embodiment of the herein described and depicted invention, a guide and feed system is provided to sequentially fold the sheet edges from horizontal to substantially vertical. As the sheet is fed, the sheet edges are moved from a flat substantially horizontal plane to vertical and then both edges are merged to form a seam which is then sewn to complete the tube. A pair of endless drive belts press the respective edges against guide surfaces and move the edges along the guide surfaces to the seam forming and sewing station of the apparatus. A driven puller wheel downstream of the sewing needles pulls the tube through the sewing machine to maintain the proper tension in the seam, and discharges the sewn tube, which is then further processed by additional steps for preparation of the filter bag, but which do not form the particulars of the present invention.

In the broadest concept, any type of fabric material may be employed and processed in accordance with the concepts of the present invention, however, the invention provides particular advantages for forming tubes of synthetic fabric materials.

Accordingly, it is a feature of the present invention to provide a sheet material tube former for manufacturing tubes or filter bags.

It is another feature of the present invention to provide a tube former for manufacturing filter bags or tubes rapidly and efficiently from fabrics of polyester, fiberglass, and acrylic.

It is a further feature of the present invention to provide a fabric tube former which forms a seam in the fabric at a substantially constant and predetermined tension so that the resulting tube takes the form of a straight cylinder rather than a banana shape.

It is another feature of the present invention to provide a tube former that premarks filter tubes in order to easily locate the position of support rings and cuffs for the tubes.

It is a further feature of the present invention to form a filter tube by gradually moving opposite edges of a flat sheet from horizontal to vertical positions by means of a curved guide surface and wherein portions of the sheet adjacent the edges are held against the surface of a driven endless belt.

It is yet another feature of the present invention to precut filter bags during the manufacture thereof and at the point in the process where the fabric is still in the form of a flat web.

It is a still further feature of the present invention to simultaneously hold down a sheet of material to be cut and to move a roll cutter between the edges of the sheet to form a cut terminating short of each edge.

It is a further feature of the present invention to cut fabric with a relatively dull roller wheel cutter pressed tightly against a flat surface of a rigid back up element.

It is a further feature of the present invention to provide a unique fabric marker for marking lines across the width of a web or sheet of fabric as the fabric is moving, without stopping the fabric, by means of a unique wick bar rigidly mounted on its reservoir and movable therewith to mark the fabric.

It is a further feature of the present invention to fully automatically mark, cut, feed, and sew a filter bag tube, without manual intervention.

It is a further feature of the invention to provide a unique method and apparatus for gripping and guiding the edges of a flat sheet to form a tube with a non-protruding flat stitched means.

It is a further feature of the invention to provide a filter tube forming apparatus which is adjustable to form tubes of several different diameters.

It is a further feature of the invention to apply to a sheet of fabric or to a filter tube, an identifying stamp mark, by means of a unique power driven ink stamper.

These and other features and advantages of the present invention will become apparent from the following detailed description, wherein reference is made to the figures in the accompanying drawings.

DETAILED DESCRIPTION

Figure 1:
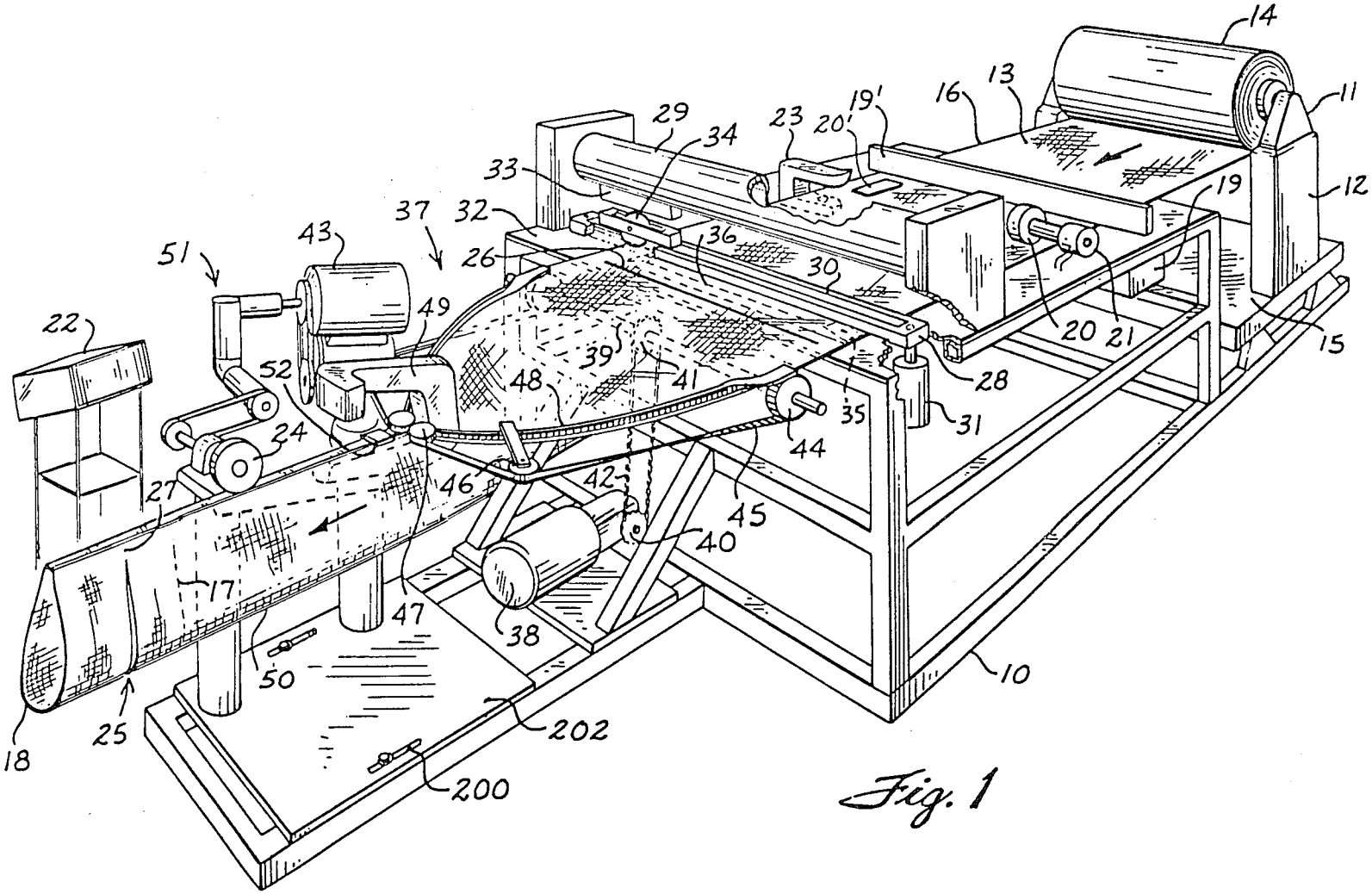
FIG. 1 is a pictorial view of one preferred embodiment of an apparatus for forming tubes, in accordance with this invention and for practicing the method of the invention.

With reference to FIG. 1, the device of the present invention is depicted and illustrated and will be seen to include a frame 10 for the arrangement on and support of the various components of the device. At one end of frame 10 is mounted a fabric guide carriage 11 which includes two upright supports 12 and 13 for holding a roll 14 of fabric material. The roll 14 is mounted on a central shaft having its ends received in and supported for rotation in uprights 12 and 13 in conventional fashion. A suitable hoist is employed to place a fresh roll of fabric in the apparatus when the previous roll is depleted. It should be noted that the supports 12 and 13 or the base 15 upon which they are mounted may be constructed so as to be shiftable laterally in order that the web 16 can be steered or centered as it progresses from the roll 14 and down the processing table. The web could, however, be steered in any conventional manner, for example, with tiltable rollers downstream of fabric roll 14.

As noted hereinabove, the fabric sheets are to be ultimately used as filter bags for air cleaning systems, and as such these bags will have attached metal rings spaced along the exterior thereof in order to support the bag and to maintain the center of the bag open for air flow. In order to assist the filter bag assembler, the device herein includes ink marker means for applying a line or stripe of ink on the sheet 16 so that as it comes off the assembly line, marks 17 appear on the exterior of the bag. Such marks 17 may be spaced at any suitable distance along the length of the bag 18, and such marks 17 provide a visual guide for the location of the support rings heretofore referred to, which can be sewn on the tube, as well as the location and length of cuffs for the resulting filter bag.

In any event, the marks 17 are formed by line marker 19 which is shown only functionally in FIG. 1 but which will later be described in detail. The line marker 19 includes an elongated hollow well or reservoir for holding ink, and a rib like felt wick along the top edge thereof. There is provided actuating means in the form of an air operated cylinder to raise and lower the marker 19 through a slot in the fabric table as the web 16 passes thereabove. Above the fabric is a fixed back up bar 19' which extends the width of the table so the fabric is lifted only slightly when the wick engages the underside of the web. There is also a stamper assembly 20' with a back up plate above fabric 16 and stamp unit below the table to stamp an identification mark on the bottom of the fabric.

Frictionally engaging the top surface of sheet 16 is a roller wheel 20 which drives an encoder 21. As is well known, wheel 20 is rotated by sheet 16 as it passes thereunder, and such rotation converted to signal pulses by encoder 21 that are fed to a controller 22 used to automatically control the marker 19 in response to the length of the web that passes beneath roller 20. Various settings can be employed whereby marks 17 can be applied at any predetermined intervals, for example, one, two, three, or four foot intervals along the web in predetermined relation to the ends of the bag to be formed, in response to the action of controller 22. As will later be explained, controller 22 also controls the length to which the web is cut.

A U-shaped fabric photo eye guide 23 is arranged downstream of the marker 19 and functions to sense any misalignment of the sheet 16 relative to a predetermined centered position on the table in its path of travel from the roll 14 towards the fabric puller roller 24. If the sheet 16 moves to the right or left in the horizontal plane along its path of travel, the change in the light received by a photocell from an opposed light source is used to sense such misalignment and emit a signal to actuate the steering mechanism to bring the sheet back into alignment. Such mechanism can be air cylinder, controlled by the photocell to laterally shift base 15 on which upright supports 12, 13 are mounted. In any event, in response to the signals from the photo eye 23, the sheet 16 is maintained in predetermined centered alignment on the table.

The next step in the production of the filter bags 18 of the present invention is to precut the web or sheet to the required length for each bag. It should be noted that it is not intended to completely sever the web but only to partially sever the web. The end result of this operation is seen in the drawing where the bags 18 issue in assembly line fashion but with a cut separating one filter bag from the next. The purpose of the cut 25 is to facilitate complete separation by snipping the uncut portions joining the bags, while providing bags with perfectly square ends, and simplifying the fabric feeders to obtain the assembly line type of issuance of the bags 18 from the device.

In any event, slots or cuts 25 are formed by slicing the web 16 at predetermined intervals along its length but not completely across the sheet from edge to edge. In other words, the slit 26 is made in the sheet 16 but terminates inwardly of each edge. This leaves a portion 27 at each edge for holding the web together, and these portions 27 can be easily snipped to sever the bags 18 one from the other, after the web is formed into a tube and the uncut edge portions are sewn.

The structure necessary to form the slits 26 comprises a fabric clamp 28 and a cut-off wheel assembly 29. Clamp 28 is seen to include a double bar 30 that extends across the width of sheet 16 and above the sheet 16. An air cylinder 31 is located at each end of the bar 30 and functions to raise and lower the bar 30. When raised, the bar 30 is positioned above the sheet 16 by a distance on the order of $\frac{1}{4}$ inch allowing the sheet 16 to pass thereunder. When cylinders 31 pull the bar 30 down, however, the bar jams the sheet 16 between itself and the top of the table 32. This action holds the sheet 16 steady so that there is no lateral shifting or wrinkling of the sheet as the cutting wheel cuts the web.

Air cylinder 29 carries a laterally shiftable carriage 33 thereunder which carriage 33 houses a cut-off wheel 34. Cylinder 29 when activated moves wheel 34 in alternate lateral directions along the width of the sheet 16 and cuts the sheet to effect the cut 26. Wheel 34 will not cut a portion at each edge of the sheet 16 for the reason that a back up bar beneath the sheet has a slanted ramp 35 whereby no cutting pressure is exerted upon the sheet by the wheel at the edges.

In other words, only the portion of sheet 16 between a flat planar surface of back up bar 36 and the wheel 34 is cut. However, as wheel 34 passes from the flat surface of bar 36 to ramp 35, the pressure on the sheet 16 is relieved and no slit is formed at the edges. With ramps 35 at each end of back up bar 36, and inwardly of the side edges of the sheet, it can be seen that a small section of sheet 1 at each of its edges will remain lateral. Cut off wheel carriage 33 will soon be further described.

Sheet 16 after having been precut, passes to the double puller belt and guide system shown generally at 37. In this system, drive motor 38 rotates shaft 39 via sprockets 40 and 41, and chain drive 42. Motor 38 is of the variable speed type as is the other motor 43. Shaft 39 has a toothed drive pulley 44, keyed to each of its ends, and around each pulley 44 is trained an endless rubber puller belt 45 with a smooth side and a toothed side. Belt 45 passes around guide pulleys 46 and 47.

Belt 45 is further supported and guided by a guide rail 48 which terminates at one end of the sewing machine 49 and at its other end adjacent drive pulley 44. Rail 48 has a vertical guide surface along a substantial portion thereof and which curves to provide a horizontal lower surface above and adjacent pulley 44. The edge of sheet 16 passes horizontally between rail 48 and pulley 44 and is caught by belt 45. Belt 45 presses edge of sheet 16 against the rail 48 and carries the edge of sheet 16 along the rail 48 towards the sewing machine 49. In this path of travel, that is from pulley 44 to machine 49, each edge of the sheet 16 is turned upwardly from the horizontal plane of table 32 to the vertical plane of the vertical guide surface of rail 48. This turning is effected near the pulley 44. The mid-portion 50 of the sheet 16 sags loosely below the rails 48.

Sewing machine 49 driven by motor 43 includes adjacent pulley 47 a seam former 52 of otherwise well known design which shapes both edges of the sheet 16 into overlapping relationship to produce a "fell" seam. The machine 49 sews the seam, and because the web is precut the bags 18 are formed with slots 25 therein. Each bag 18 also includes the uncut section 27 and the lines 17 applied by the marker 19. Puller roller 24, also mechanically connected to motor 43, draws the bags 18 through sewing machine 49 toward a downstream station (not shown) where the bags 18 are cut at 27 and are further processed.

Puller roller 24 is driven at a speed preferably very slightly greater than the forward component of the speed of the web along the guide rails to maintain a predetermined longitudinal tension in the material at the seam, as the seam is sewn. There can be very slight slippage between the puller roller and the fabric. Sewing machine 49 is driven to sew the seam at a speed equal to the linear speed of travel of the material at the machine.

In operation, motors 38 and 43 are activated drawing the sheet from roll 14. As the sheet 16 passes from the roll 14 toward cutter 29, line marker 19 applies the ink lines 17 to the sheet 16 at predetermined intervals, while sheet 16 is moving. Photo eye 23 monitors and maintains the lateral alignment of the sheet 16. Motors 38 and 43 are then stopped, and clamp 28 presses sheet 16 against table top 32. Cylinder 29 moves knife wheel 34 across the sheet 16 and provides slice 26. Motors 38 and 43 are then again activated and the edges of the sheet 16 are pulled into rail 48 between the rail 48 and the belt 45. The sheet edges pass to pulley 47 where they are overlapped into a "fell" seam, and the seam is sewn by the sewing machine 49. Puller wheel 24 driven by motor 43 via drive connection 51, moves the bags 18 to a downstream station where the portions 27 of the bags are cut, and where hoops can be installed at lines 17 marked on the bags. Stamper 20' is actuated to print identification markings on the sheet while the sheet is stopped and being cut.

THE LINE MARKER

Figure 2:
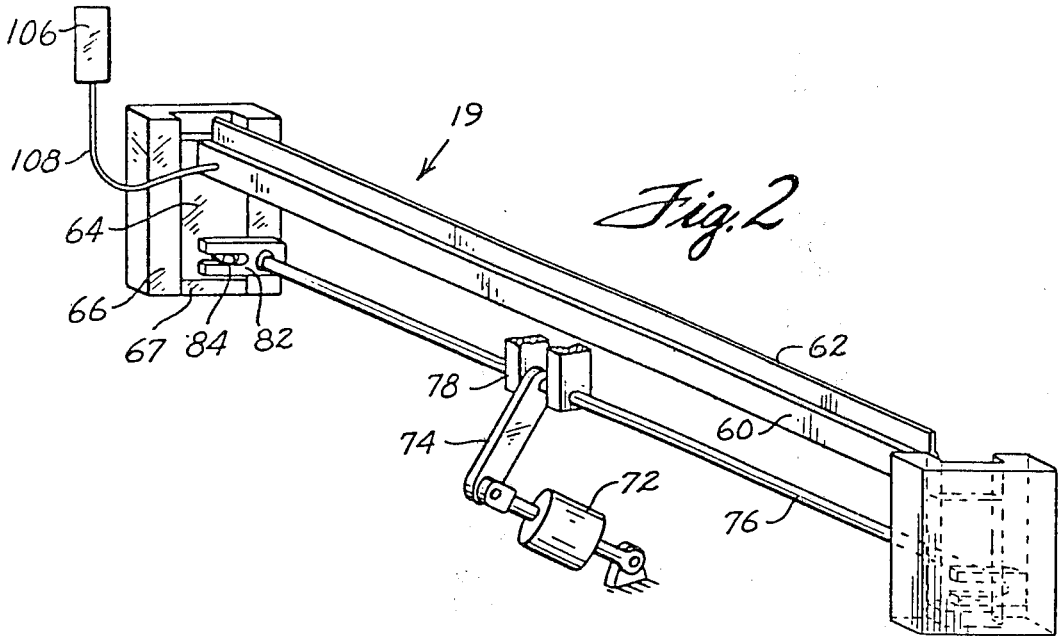
FIG. 2 is a pictorial view of the line marker which forms part of the apparatus of FIG. 1.
Figure 3:
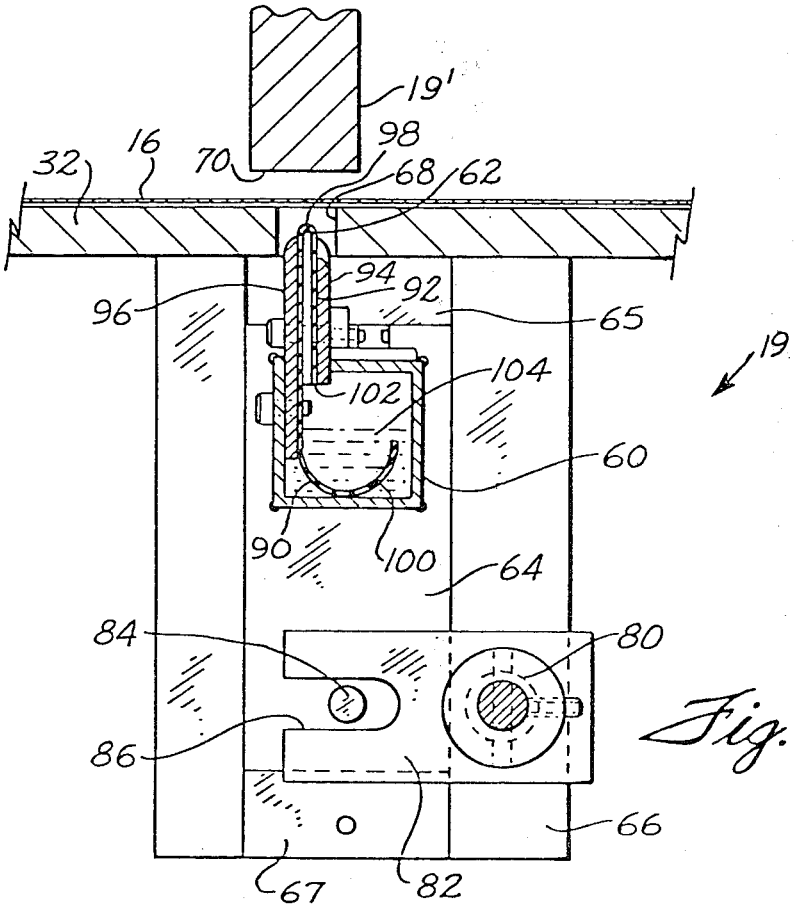
FIG. 3 is an enlarged view in section taken along line 3—3 of FIG. 2.

FIGS. 2 and 3 show the ink marker 19 in greater detail. As shown, there is an elongated reservoir or container 60 with a wick bar 62 fixed to the reservoir for movement therewith. Reservoir 60 is a hollow rectangular tube with its ends closed. Fixed to each end of reservoir 60 is a slide plate 64 guided for vertical movement in a slot 65 of a guide plate 66 which is fixed relative to table 32. Vertically above wick bar 62 is the back up bar 19' which is fixed to the table 32 at a distance of about ¼ inch above the top surface of the table so that fabric sheet 16 can move freely along the table when the wick bar is in its lower or retracted position in which slide plate 64 rests on stop bar 67, as shown at FIG. 3. The wick bar 62 is aligned with a slot 68 in table 32, and when operated, moves upward through slot 68 to lift fabric 16 into momentary engagement with the bottom surface 70 of back-up bar 19'. In this way, an ink line is printed across the width of the fabric on its bottom surface by wick bar 62.

The mechanism for driving the wick bar 62 is shown at FIG. 2. An air cylinder 72 is pivoted to a drive arm 74 fixed to a shaft 76 supported for rotation in bearing blocks 78, one on each side of arm 74, and in a bearing 80 (FIG. 3) fitted into the guide plate at each end of the shaft. A forked crank arm 82 is fixed to each end of the shaft 76. A pin 84 fixed to slide plate 64 extends into a slot 86 of crank arm. When cylinder 72 is extended crank arms 82 pivot clockwise to simultaneously drive pins 84, and slide plates 64 upwardly, thereby lifting wick bar 62 to print a line across the width of fabric 16. Cylinder 72 is advantageously of the "one-shot" type which automatically retracts rapidly as soon as its piston extends to a predetermined position.

Wick bar 62 includes a wick element 90 in the form of a sheet of felt or other absorbant material which is wrapped around a flat spring steel reinforcement strip 92. Side plates 94 and 96 which extend the length of the bar are secured to the opposite vertical faces of the wick and spring to maintain them rigid along most of their height, but leaving an exposed wick marking tip 98 along the top of the bar. A slot is formed in the top of reservoir 60 and the bar assembly, which is a close fit in the slot, is inserted partly into the reservoir and secured to the reservoir with screws. Gaskets and sealants are used to prevent any leaking of the ink when the assembly reciprocates.

As will be observed from FIG. 3 each of the ends 100 and 102 of the wick is exposed to ink 104 in reservoir 60. When the reservoir reciprocates, the ink splashes onto end 102 so that there is a wick action along both sides of the wick element to exposed tip 98.

Ink is supplied to reservoir 60 from a container 106 (FIG. 2) through a flexible tube 108 connected to the reservoir.

THE CUTTING ASSEMBLY

Figure 4:
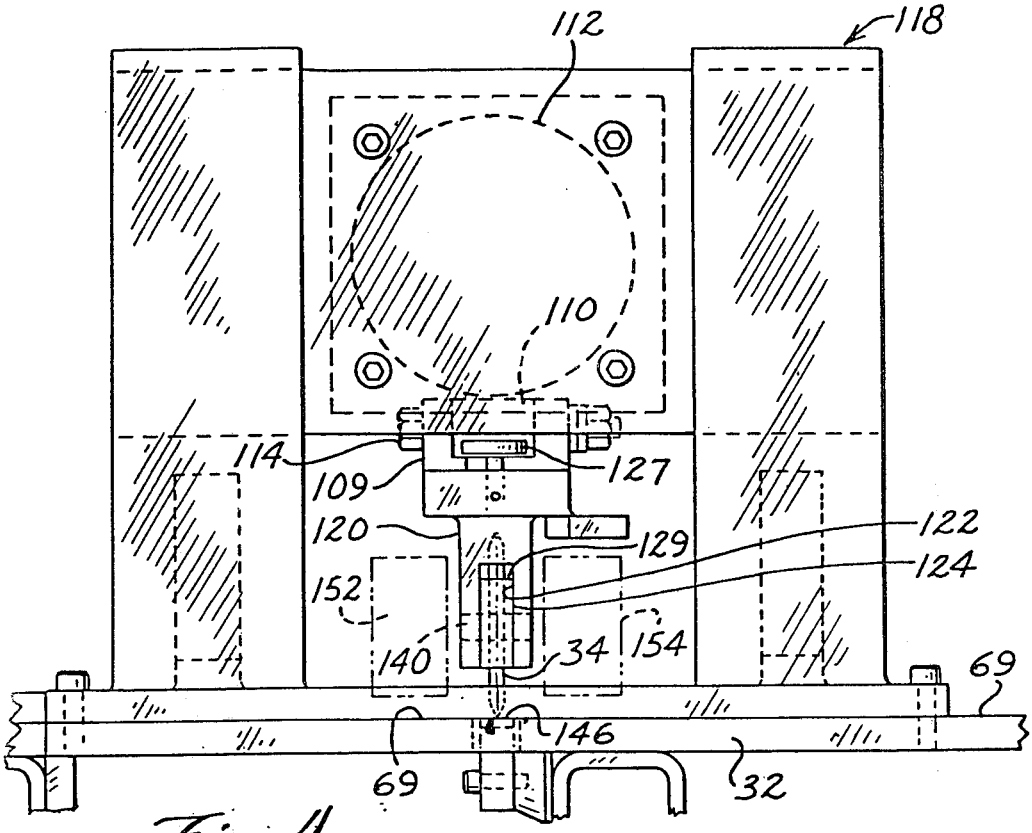
FIG. 4 is an enlarged end view of the cutting assembly of the apparatus of FIG. 1 looking generally along line 4—4 of FIG. 1.
Figure 5:
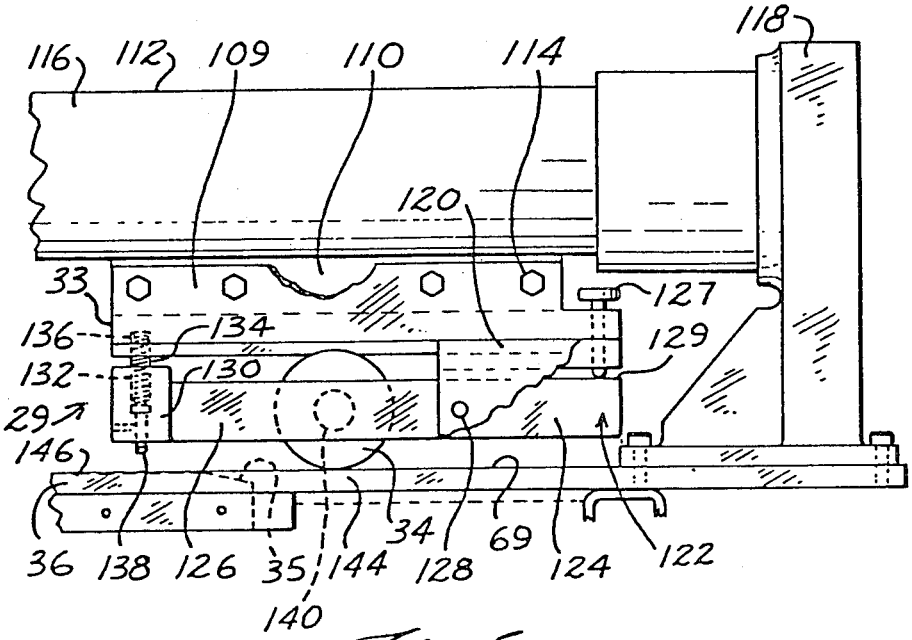
FIG. 5 is a front view of the right hand end of the cutting assembly of FIG. 4.

Cutting assembly 29 is shown in greater detail at FIGS. 4 and 5. As previously described, cutting assembly 29 includes a carriage 33 on which cut-off wheel 34 is mounted. Carriage 33 has a generally U shaped upper portion 109 to receive a rectangular drive bar 110 of the pneumatic motor 112, and to which the carriage is secured by bolts 114. Motor 112 is a "rodless air cylinder", which traverses drive bar 110 longitudinally from one end to the other of the tubular housing 116 of the motor. It will be appreciated that any known form of drive arrangement can be used in place of this "rodless cylinder", for example, a reversible motor driven traverse mechanism, the only requirements being that the mechanism drive the cut-off wheel 34 the width of table 32, be reversible, and be able to resist the upward thrust imposed by the cut-off wheel 34 during its traverse.

Motor 112 is rigidly mounted to table 32 by robust fabricated mounting brackets 118 at each side of the table, and which are seated on the top surface 69 of the table and are bolted to the table and its understructure.

Fixed to the cut-off wheel carriage 33 and ofset toward one end (the right hand end as viewed in FIG. 5) is a downwardly extending support plate 120 having a downwardly opening slot 122 which extends the length of the plate. Extending into slot 122 is a rectangular end 124 of a cut-off wheel holder 126. Holder 126 is connected to plate 120 for pivotal movement about a vertical axis, by a pivot pin 128. End 124 is of a width to be a close fit in slot 122 to avoid lateral movement in the slot. A stop screw 127 threaded vertically through plate 120 near its end engages top face 129 of end 124.

The cut-off wheel holder extends the length of carriage 33 and has an enlarged end 130 with an upwardly opening bore 132 to receive a helically wound compression spring 134 which extends upwardly and has its upper end seated in a blind bore 136 in the upper portion 109 of the carriage. A stud 138 threaded into the bottom of bore 132 engages a moveable spring seat in the bore and provides a means for adjusting the compression of the spring. Cut-off wheel 34 is mounted for rotation near the center of holder 126 by a pin 140. Wheel 34 is a close fit in a vertical slot 142 of holder 126 to prevent sideways movement of the wheel as it rolls when making a cut.

Formed in table 32 in alignment with the path of travel of cut-off wheel 34 is a slot 144 which extends the width of the table. Positioned in the slot and fixed to the table is the back up bar 36 which is formed from hardened steel and presents a flat top surface 146. Each end of bar 36 has a downwardly beveled ramp 35.

Figure 6:
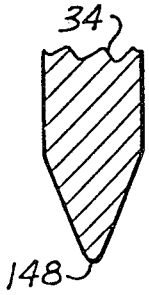
FIG. 6 is a partial enlarged view in radial section of the cutting wheel.

Cut-off wheel 34 has a cutting edge 148 which is rounded as shown at FIG. 6, rather than sharp. Wheel 34 cuts fabric 16 by a crushing action rather than a shearing action. This is accomplished by using a heavy spring 134 to force wheel holder 126 downwardly so there is a substantial downward load when wheel 34 is on back up surface 146. Because of the small areas of engagement between cutting edge 148 and surface 146, a tremendous pressure is exerted during cutting.

Stop screw 127 is adjusted to limit the amount the wheel 34 can drop as it rolls beyond surface 146. Screw 127 is so adjusted that wheel 34 contacts only about the upper ⅓ of the ramp 35. There is, of course, no cutting of the fabric after the wheel leaves ramp 35, since the wheel is then over table slot 144, and only slightly depresses the fabric in this region with its rounded edge 148. In the position shown at FIG. 5, wheel 34 is at the extreme end of its travel and is beyond the side edge of the fabric.

As previously described, fabric 16 is cut only after its feed is stopped and it is clamped to the table. Clamp bar 30 has two bar portions 152 and 154 as shown in phantom lines at FIG. 4. The bar portions extend the width of the fabric and when pulled down by cylinder 31 (FIG. 1), clamp the fabric along each side of the line of the cut of wheel 34. The bottom surfaces of bar portions 152 and 154 are faced with resilient sheets to grip the fabric and prevent damage to the fabric when the clamp bar is lowered.

THE PULLER BELT AND GUIDE

Figure 7:
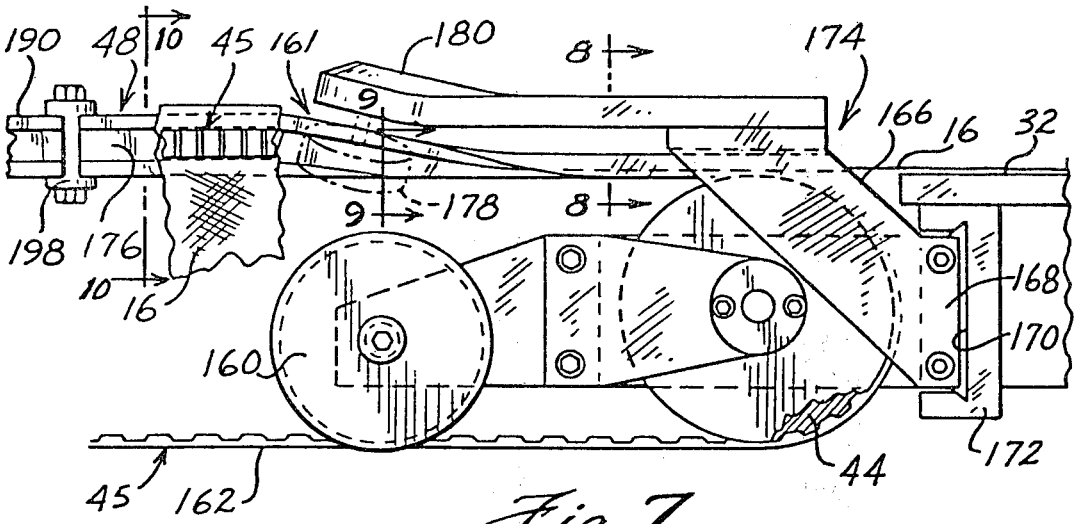
FIG. 7 is an enlarged end view of the belt and rail looking along lines 7—7 of FIG. 1.

FIG. 7 shows the puller belt and guide in the region of drive pulley 44 in greater detail. As shown at FIG. 7, there is an additional pulley 160 which functions as a guide for the return flight 162 of toothed belt 45. Belt 45 is toothed on one side to assure driving the belts at opposite sides of the apparatus at essentially the same speed.

Drive pulley 44, guide pulley 160 and the inlet portion 161 of rail 48 are mounted on a common mounting bracket 166 at the forward end of table 32. The mounting arrangement preferably includes a dove-tail 168 and a dove-tail slot 170 in a mounting plate 172 which is secured to the table. This dove-tail and slot arrangement permits adjusting the inlet end 174 of rail 48, where fabric 16 is initially engaged by belt 45 and pressed against the rail. As shown at FIG. 7, belt 45 extends around drive pulley 44 and enters a U-shaped recess 176 formed in rail 48. The fabric 16 is fed into the region between the smooth outer surface of the belt or drive pulley 44 and the slot 176 at the inlet region 174.

Rail 48 is provided with a 90° twist. At the inlet of its slot 176, the guide surface of the slot is horizontal so that the sheet adjacent its edge, is gripped while in a horizontal plane. As the belt travels along slot 176 the twist in the rail and slot folds or turns the gripped edge upwardly to a vertical position. To assure that belt 45 remains in the slot 176 in engagement with the fabric, a supplemental roller 178 (shown in phantom lines and mounted on a support arm 18) is provided in the region between the horizontal and vertical portions of slot 176.

Figure 8:
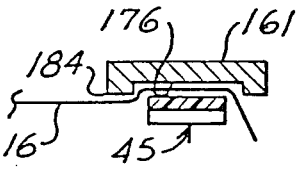
FIG. 8 is a schematic view in section taken along line 8—8 of FIG. 7.
Figure 9:
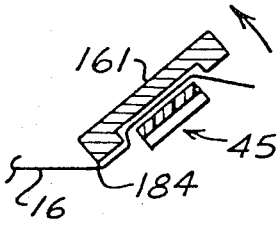
FIG. 9 is a schematic view in section taken along line 9—9 of FIG. 7.
Figure 10:
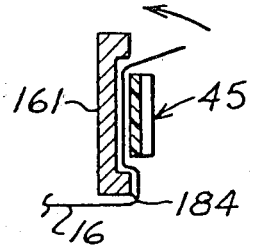
FIG. 10 is a view in section taken along line 10—10 of FIG. 7.

FIGS. 8–10 show schematically, the action of the rail and belt in folding the edge of the fabric upwardly. FIG. 8 shows the position of fabric 16 at the inlet 174, FIG. 9 shows the position of the fabric edge partially turned upwardly, and FIG. 10 shows the position of the fabric edge in its vertical state. To avoid any possibility of slipping of the sheet laterally after it is gripped between belt 45 and slot 176, rail portion 161 is twisted in such a manner that its edge 184 extends along a straight line parallel to the direction of feed of the fabric. This assures that there will be no tension change laterally of the fabric while its edge is turned from the horizontal to the vertical position.

The reason for mounting bracket 166 which supports the drive pulley and the portion 161 of rail 48 in a dove-tail, is to permit shifting this assembly slightly so that a greater or lesser portion of the edge of the fabric can be gripped, at either side. Initially, the drive pulley and inlet portion of the rail at the opposite sides of the apparatus are set so that at one side, the width of the edge gripped is greater than the width gripped at the other side. Correspondingly, when the two widths are brought into engagement at the downstream ends of the rails, one edge extends above the other edge by a distance sufficient to form a "fell" seam, which constitutes the flat interlocked seam shown at FIG. 11.

It will be observed from FIG. 1 that rails 48 each curve inwardly over a substantial portion of their length between pulley 44 and pulley 47. By virtue of this arrangement, the tension in the belt between pulley 44 and pulley 47 presses the belt toward and into the groove of rail 48 thereby frictionally gripping the edge of the fabric. However, where curved rails are used as shown in FIG. 1, it is necessary to substitute different rails when it is desired to form a bag of a different diameter, for example, a bag somewhat smaller than bag 18 formed by the apparatus.

Figure 12:
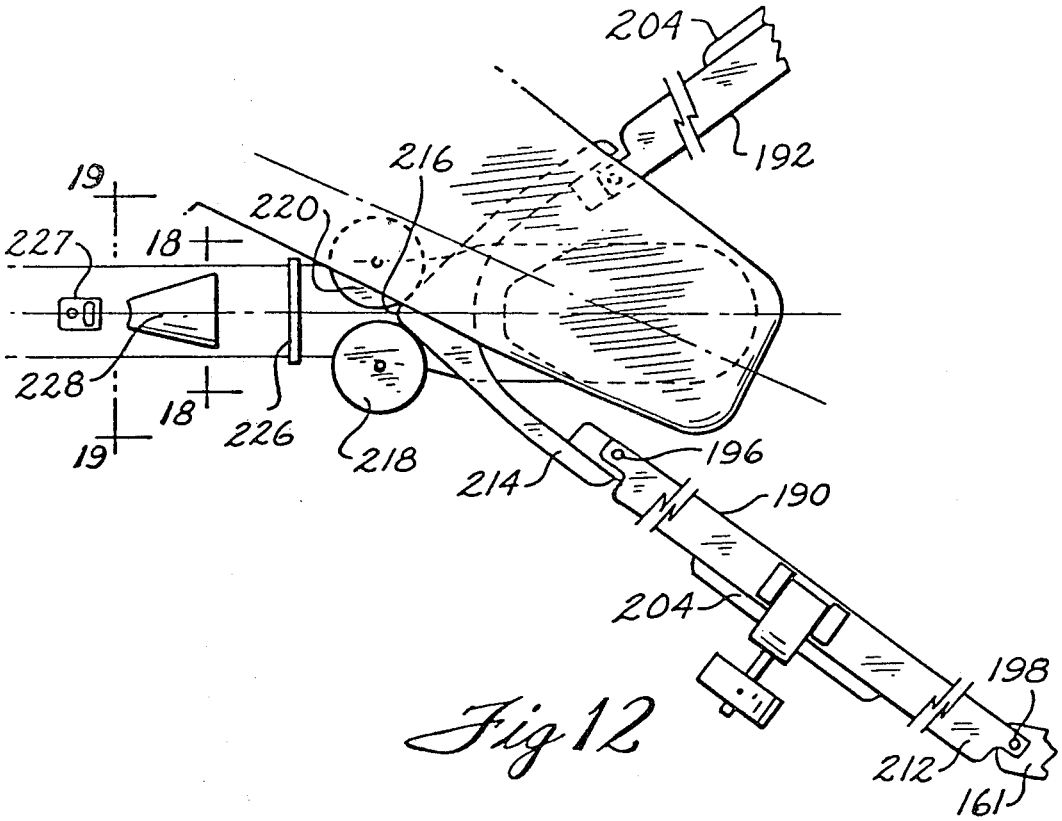
FIG. 12 is a partial view in plan of a different embodiment of guide rail assembly from that shown at FIG. 1, and also shows a portion of the sewing machine.

A more versatile arrangement is shown at FIG. 12, where the rails are each straight rails 190, 192 between a guide bracket 194 and the portion 161 of the rail which turns the fabric edge upwardly. Each rail is pivoted to the guide at a pivot 196 and is also pivoted to rail portion 161 at a pivot 198. Such an arrangement permits adjusting the apparatus to accommodate fabric of substantially different widths to enable forming filter tubes of substantially different diameters, for example, in the range of 6 to 15 inches. Such adjustment is accomplished by sliding the portions 161 inwardly or outwardly in their respective dove-tail supports on table, while simultaneously moving the entire sewing machine assembly fore or aft which is permitted by virtue of slots 200 in a base plate 202 (FIG. 1) which provides for such adjustment of the entire assembly mounted on this base plate.

However, when the straight rails 190, 192 of FIG. 12 are provided, the component of tension in the belt directed toward the rail is insufficient to securely hold the fabric against the rail. Correspondingly, where rails 190, 192 are used, each rail is provided with a pressure pads 204 pivotally connected to the rail at a pivot connection 206, and provided with a counter-weight 208 which can be adjustable to vary the pressure exerted by the pad on the outer surface of the belt.

Each straight rail has a groove 212 formed therein of the same height as and aligned vertically with the groove 176 of rail portion 161. Similarly, there is a groove 214 in guide bracket 194, this groove 214 gradually dissappearing at the nose 216 of the guide bracket adjacent the pulleys 218, 220.

Belt 45 pulls the fabric with its edge vertical from rail portion 161 onto rail 190 where the counterweighted pads 204 apply sufficient pressure to the belt to enable it to maintain its grip on the fabric. Belt 45 then carries the material along the guide surface 214 of guide bracket 94 to a position between the nip of pulleys 218, 220.

Figure 11:
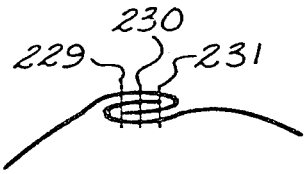
FIG. 11 is an end view of a fell seam formed in the tube.
Figure 13:
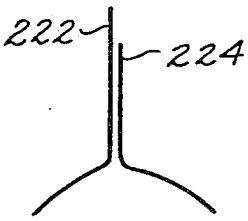
FIGS. 13–17 are end views in section showing the sequence of folding of the edges of the fabric to form the fell seam of FIG. 11.
Figure 14:
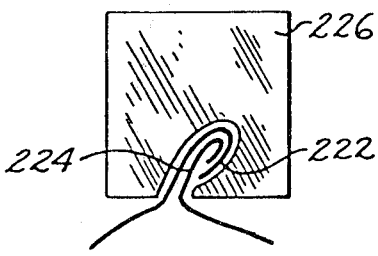
Figure 15:
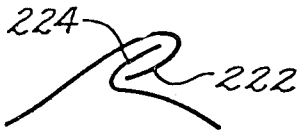
Figure 16:
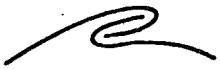
Figure 17:
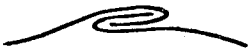

As previously mentioned, more of the fabric is gripped at one edge than at the other edge so that when the edges are brought together between the rollers 218, 220, edge 22 extends above the opposite edge 224, as shown schematically at FIG. 13. After passing between rollers 218, 220, the fabric with the edges together has the edge 222 rolled or folded downwardly over edge 224 as it passes through a preliminary former plate 226. The condition of the fabric with edge 222 folded over edge 224 as it passes through former plate 226 is shown at FIG. 14. Next, the fabric feeds to a seam folder 22 8 which folds the fabric further in the sequence shown at FIGS. 15–17, the flat folded condition of FIG. 17 representing the condition of the seam as it passes under the presser foot 22 7 of the sewing machine, in which condition the seam is stitched by the sewing machine. It is preferred that the seam be stitched by a triple needle so that three rows of stitches 229–231 are formed through the seam, as shown at FIG. 11.

Figure 18:
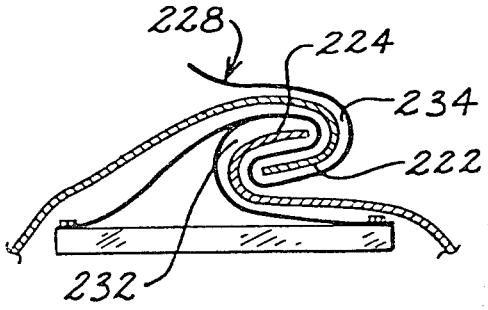
FIG. 18 is a view in section of the inlet end of a fell seam folder taken along line 18—18 of FIG. 12.
Figure 19:
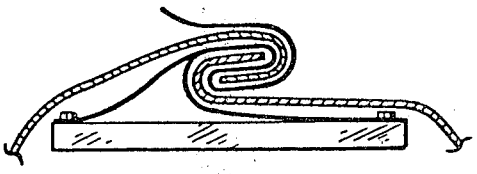
FIG. 19 is an end view in section of the outlet end of the fell seam former taken along line 19—19 of FIG. 12.

Seam folder 228 is shown in greater detail at FIGS. 18 and 19. It will be observed that the folder takes the form of a curved guide plate bent to provide two guide slots 232, 234, which further fold the fabric edges, but individually, toward their folded fell seam position. These slots 232 and 234 gradually narrow and flatten longitudinally toward the downstream end of the folder so that the fabric emerging from the folder need only be flattened by the presser foot of the sewing machine at the time of stitching.

THE PULLER WHEEL ASSEMBLY

It has been found that conventional feed dogs of a sewing machine are not of such construction to handle and feed heavy sheet material such as glass fiber. Accordingly, and as illustrated and depicted in FIG. 20, there is seen the details of the puller wheel system 24 shown generally in FIG. 1 which puller wheel 24 operates and functions in place of the feed dog normally present in a sewing machine.

Thus, there will be seen machine 49 having the platform 49A and sewing head 49B. The feed dog normally located below head 49B for advancing the fabric after each stitch has been eliminated and an extension member 250 is bolted at 251 to the platform 49A. Member 250 includes a free idling roller member 252 located in bearings 253 and which roller 252 is disposed below but at the surface 254 of extension member 250. A gap 255 in surface 254 of extension member 250 allows the roller 252 to contact the sheet material 16 as it passes thereover.

Fabric puller wheel 256 is seen in engagement with the surface 254 of extension 250 just above the gap 255. Thus, the sheet material is sandwiched between the surface 257 of the wheel 256 and the surface of roller 252 exposed by the gap 255. As wheel 256 is turned by motor 43, the sheet material 16 is pressed between wheel 256 and roller 252 with the result that the sheet material 16 is fed along for sewing of the seam by head 49B. A feed rate on the order of 12–16 yards per minute is performed for most applications. Wheel 256 includes a resilient cover 258 to contact the sheet material 16 and such cover 258 has interior tabs 259 which interlock with notches 260 in wheel 256 to keep cover 258 from slipping on wheel 256. Cover 258 is conveniently of rubber material in order to provide a surface that will better grip the sheet material 16 in order to advance it past the sewing head 49B.

It is to be noted particularly that puller wheel 24 is driven to rotate continually rather than intermittently to pull the fabric through the sewing machine, during stitching. This is in contrast to the normal intermittent feed of a sewing machine provided by the feed dogs. As previously explained, drive wheel 24 is driven by the motor 43 which also drives sewing machine 49. The speed at which the puller wheel is rotated with respect to the up and down movement of the needles of the sewing machine determined the length of each stitch sewn by the machine. It has been found that the needles of the sewing machine are sufficiently flexible that an intermittent feed need not be used.

Figure 20:
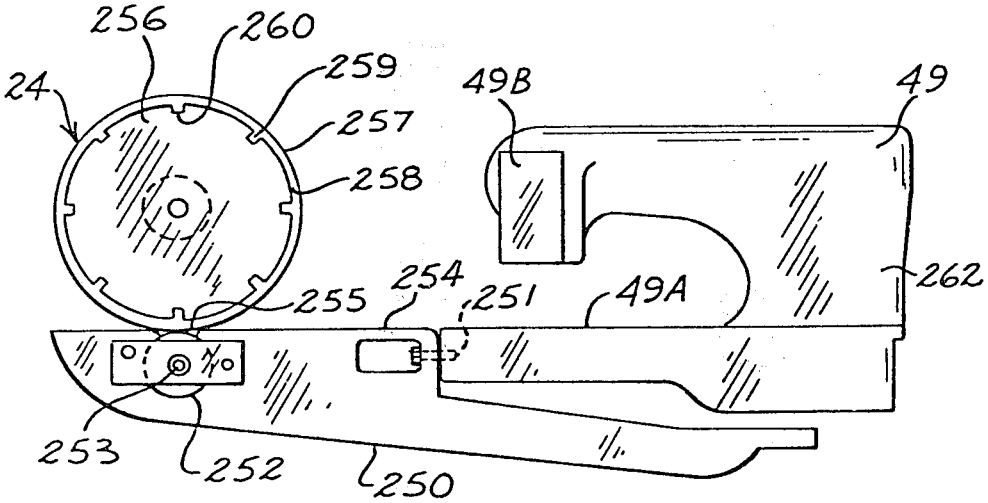
FIG. 20 is a side view of the puller wheel and sewing machine of the apparatus of FIG. 1.

It will be further noticed from FIGS. 12 and 20, that the edges of the fabric are brought together just downstream of the support post 262 of the sewing machine, and that the tube then sewn is conveyed along extension arm 250 by the puller wheel 24.

As previously explained, the puller wheel is driven at a speed essentially the same as the forward component of the speed of the fabric in the puller belt and guide, and maintains a predetermined tension in the fabric at the sewing head, so that the resulting tube is perfectly straight rather than banana shaped.

THE STAMPER

In FIG. 1, there is depicted a stamper 20′ for applying markings to the sheets 16 as they pass from the roll 14 to the cutter assembly 29. The stamper 20′ is seen in more detail in FIGS. 20 and 21 and is located below table 32. An opening 280 in table 32 enables the surface 281 of the stamper to contact the sheet 16 and move it upward against a back-up member 282 which holds sheet 16 as stamper surface 281 imprints the ink impressions thereon.

Figure 21:
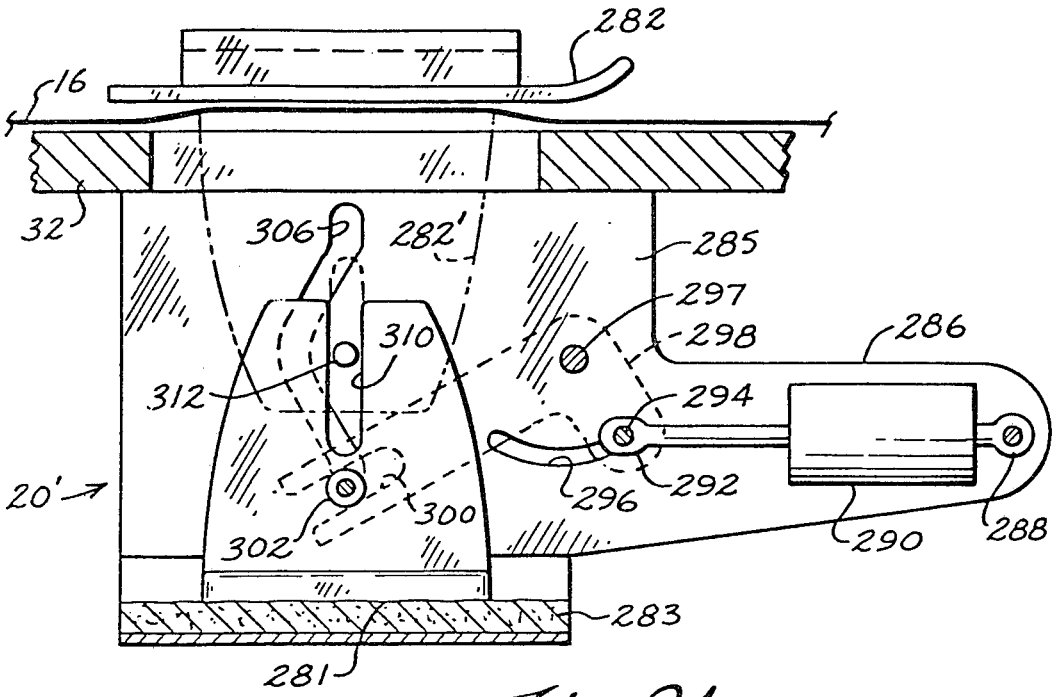
FIG. 21 is a side view in partial section of the stamper assembly mounted under the feed table.

The motion of stamper surface 281 between its retracted position shown in solid lines in FIG. 21 and its stamping position shown by phantom lines 282′ is such that there is initially a straight line upward movement away from ink pad 283, then clockwise pivotal movement to a position in which the stamper surface 281 is horizontal and faces upwardly, and then straight line upward vertical movement toward and into engagement with the sheet 16 below back-up member 282.

In the non-stamping position, stamper surface 281 rests against ink pad 283 where the indicia on surface 281 are inked. The ink pad is supported by a pin 284 secured to side plates 285 of the stamper assembly and the upper ends of which are secured to the underside of the table 32 to support the stamper. Each side plate 285 has a horizontal extension 286. Extending through the extensions 286 is shaft 288 on which one end of an air cylinder 290 is pivoted. The air cylinder has its piston rod extending generally horizontally, and has its rod end 292 pivotally connected to a shaft 294 which extends through arcuate slots 296 in each side plate 285.

Pivotally mounted on the outside of each side plate 285, by a connecting shaft 297, are identical crank arms 298. The shaft 294 extends through openings in the short ends of crank arm 298 to join the arms for movement in unison when air cylinder 290 is actuated. The long portions of each crank arm 298 have elongated slots 300. Extending into these slots are bearings 302, one at each end of a rod 304 which extends through cam slots 306 formed in each plate 285.

Figure 22:
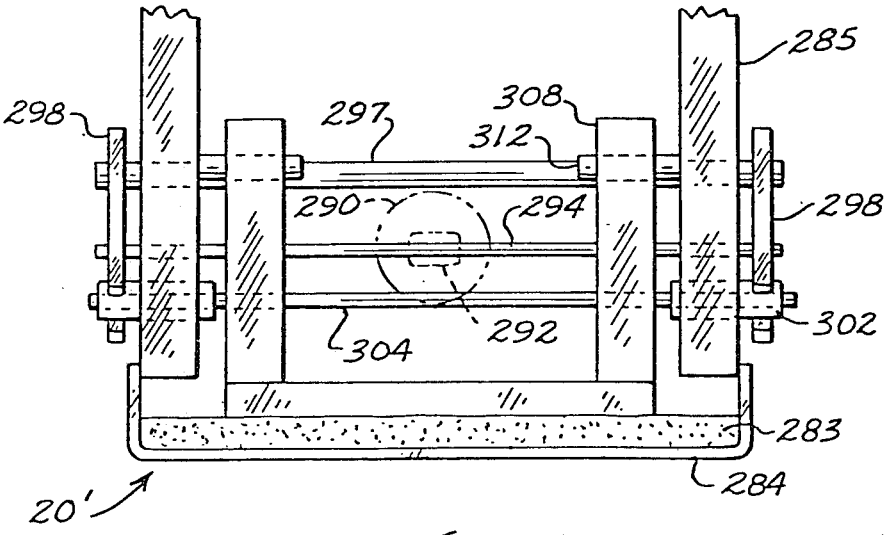
FIG. 22 is an end view of the stamper assembly of FIG. 21.

As shown at FIG. 22, stamper surface 281 is secured to side support elements 308, each of which has a central slot 310. Rod 304 extends through and is secured to the side plates, whereas a pin 312 is fixed to each support plate 285 and extends into slot 310.

The motion of the stamper surface 281 between its solid line and phantom line positions is controlled by the configuration of cam slot 306, pins 312, and slot 310. As crank arms 298 pivot clockwise (FIG. 21), the assembly of stamper surface 281 and side plates 308 initially moves vertically until bearings 302 reach the curved portion of cam slot 306, at which time the assembly is tilted to pivot about pins 312 to assume an upright vertical position at the end of the curved portion of cam slot 306. The assembly then moves vertically upwardly to the phantom line position 282' as a result of the guidance of the straight portion of cam slot 306 on bearings 302, which motion is permitted by the slot 310 with respect to pins 312.

It will be appreciated that arcuate slot 296 extends circumferentially with respect to the axis of shaft 297, and assists guiding and supporting the shaft 294.

This stamper assembly is found to be of relatively low cost and rugged construction and is quite reliable and efficient in operation. When air cylinder 290 is actuated to extend its piston rod, arms 298 are dirven to in turn drive the stamper surface 281 to print indicia on the bottom of sheet 16 by engaging the sheet and lifting it upwardly against back-up member 282.

THE CONTROLLER

The controller 22 controls both the length of the fabric between cuts 36 (the length of the bag) and the position of each ink line applied to the fabric, in response to control signals from the encoder 21. The controller 22 is of the presettable type to permit the operator of the apparatus to preset the distance between cuts as well as the positions of ten or so ink lines on each bag to an accuracy of 0.1 inch.

Figure 23:
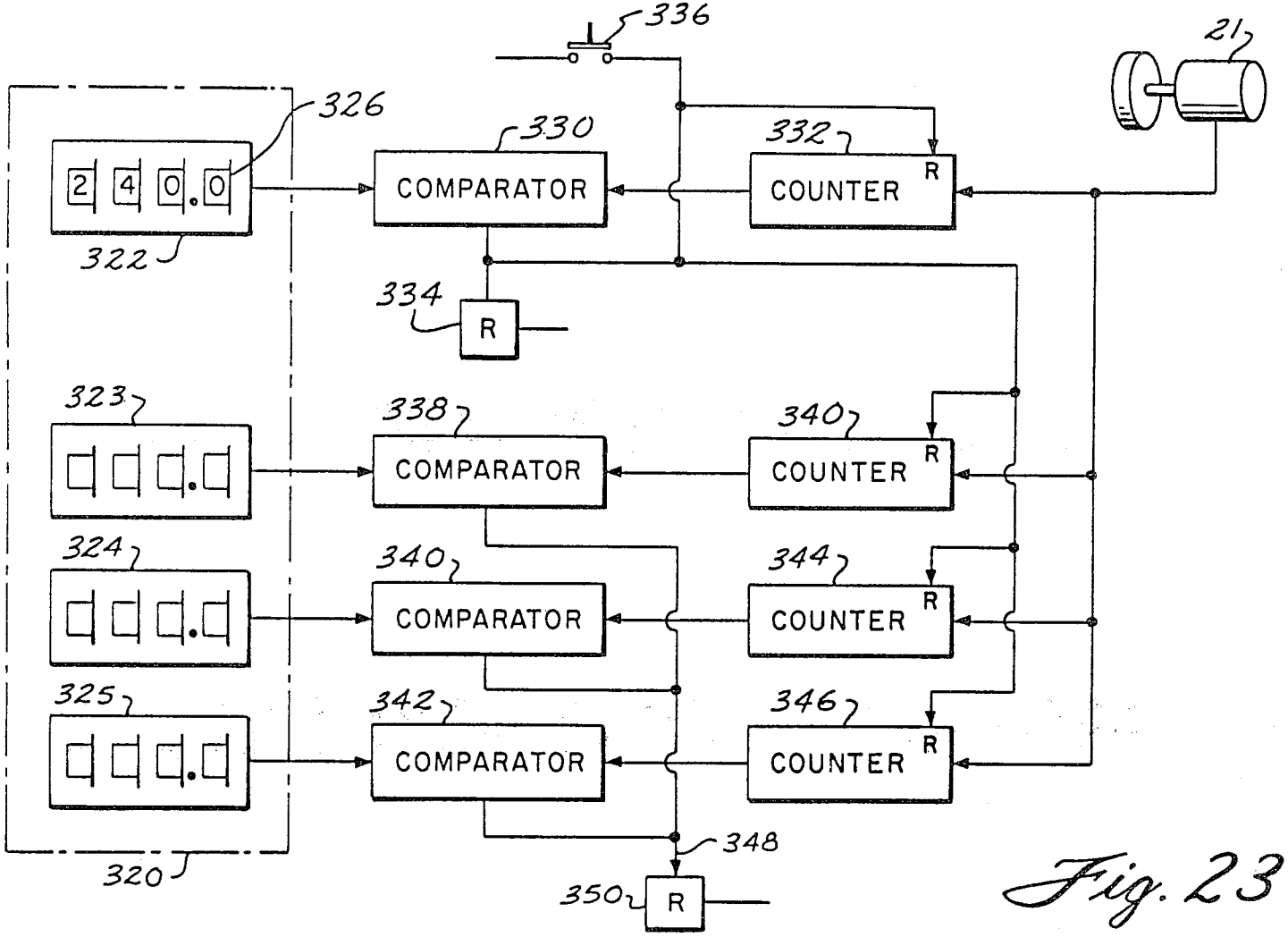
FIG. 23 is a block diagram of the controller for controlling the bag length and ink line marker.

As shown at FIG. 23, controller 22 includes a control panel 320, on which are mounted plural sets 322–325 of thumb wheel rotary switches 326. Each thumb wheel switch is a ten position switch and carries indicia thereon indicative of its position between 0 and 9. The four switches in the unit 322 are indicative of inches of bag length, and can be set to cut the sheet in lengths as long as 999.9", although the length of most bags does not exceed about 20', i.e. 240". Unit 322 controls the bag length between cuts, and includes a comparator 330, a counter 332 which receives pulses from encoder 21, and a cut control relay 334 which operates in response to a signal from the comparator. Comparator 330 compares the setting of the thumb wheel switches of unit 322 with the count in counter 332 of the pulses received from encoder 21. The circuit arrangement is such that when the count in counter 332 equals the setting of the switches of unit 322, comparator 330 emits a signal which actuates cut control relay 334. The signal from comparator 330 also resets counter 332. There is also provided a manual reset 336, which permits the operator to reset the counter if, for example, a flaw in the fabric is noticed so that the section containing the flaw can be cut on either side and later removed after the tube is formed.

Switch units 323–325 enable presetting the location of the ink lines marked on the fabric by the line marker 19 although only three units 323–325 are shown, there can be another ten or so of such units to permit marking, for example, up to thirteen or so lines along the bottom of the fabric between each cut. Connected to unit 323 is a comparator 338 which receives signals from a counter 340 which in turn receives pulses from encoder 21. Similar comparators 340 and 342 are connected to units 324 and 325 respectively, and there are further counters 344 and 346. It will be observed that each of the counters 340, 344 and 346 receives pulses from encoder 21. When the count in counter 340 reaches the preset value of unit 323, comparator 338 emits a signal on line 348 to actuate the marker control relay 350. The comparators 340 and 342 operate similarly to emit signals when the counts in the respective counters 344 and 346 equal respectively the preset value of units 324 and 325.

All the ink line marks applied to the sheet are applied relative to the location of the cut formed in the sheet and comparator 330 when it actuates cut control relay 334 also emits a signal which resets counters 340, 344 and 346.

THE CONTROL SYSTEM

Figure 24:
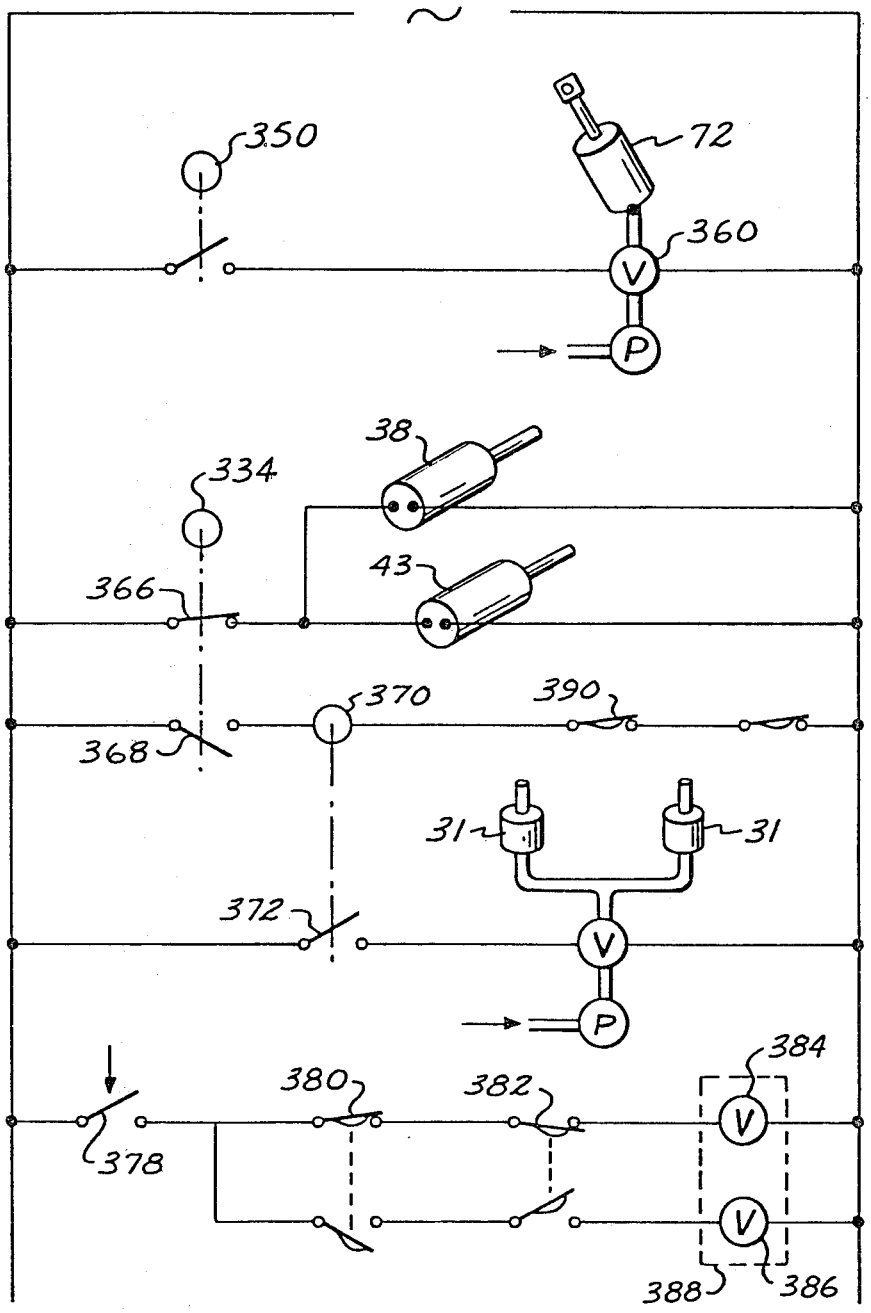
FIG. 24 is a schematic view of the controls for controlling the apparatus in response to actuating signals from the controller of FIG. 22.

Ink marker 19 is actuated each time a signal on line 348 (FIG. 23) closes marker control relay 350. This is accomplished by the arrangement shown in FIG. 24 where relay 350 operates a solenoid valve 360 which opens momentarily to supply air to air cylinder 72 which raises the wick bar 62 to mark the fabric. As previously explained, such actuation of cylinder 72 occurs while sheet 16 is moving along the feed table.

Cut control relay 334, when it is actuated by a signal from comparator 330, initiates the cutting sequence. When relay 334 is actuated, its normally closed contacts 366 open to de-energize drive motors 38 and 43, thus stopping the feed of web 16. Simultaneously, the normally open contacts 368 close to energize clamp control relay 370. Energizing relay 370 closes contacts 372 which actuate a four-way valve 374 to admit air to cylinders 31 to cause clamp bar 30 to be pulled down against the fabric. Four-way valve 374 is of the type which when unenergized admits air to cylinders 31 to maintain clamp bar 30 elevated, but actuates the cylinders to pull the bar down so long as the valve is energized.

Mounted in the path of travel of the piston rod of a clamp cylinder 31 is a momentary contact micro switch 378 connected in series with limit switches 380 and 382 in turn connected respectively to the solenoids 384 and 386 of a four-way valve 398 which controls the air cylinder of cutting assembly 29. Four-way valve 388 is of the type which remains in the position to which it is set by energizing one or the other of the solenoids 384 and 386, but only so long as the respective solenoid is energized. When the solenoid is de-energized, the valve automatically assumes a neutral position.

When cylinders 31 move the clamp bar 30 to its clamped position, micro switch 378 is closed to cause energization of solenoid 384 thereby actuating valve 388 to cause air cylinder 29 to actuate the cutter and move from left to right across the fabric. As the cutter approaches the right hand end of its travel, it first actuates a limit switch 390 which de-energizes the four-way valve 374 thereby releasing clamp bar 30 and causing it to move upwardly. As the clamp bar moves upwardly, the micro switch 378 opens. However, switch 382 is so positioned in the path of travel of the carriage of the cutter wheel, that it is actuated immediately after limit switch 390 opens and micro switch 378 opens in response to upward movement of clamp bar 30. Closing switch 382 re-sets the system so that solenoid 386 is actuated the next time that micro switch 378 is closed. Correspondingly, the next time the clamp is pulled down, four-way valve 388 is energized in the opposite direction to cause travel of the carriage from right to left.

When limit switch 390 was opened by movement of the carriage toward its end position, relay 370 was simultaneously de-energized thereby closing its normally open contacts to re-energize motors 38 and 43. Feeding and sewing of the fabric is thus resumed until the next control signal again actuates cut control relay 334 to again stop the drive, actuate the clamp, and shift the cutter assembly from right to left.

While several preferred embodiments of the method and apparatus of this invention have been shown and described, it is to be understood that numerous changes, modifications, and variations can be made without departing from the scope of the invention as set forth in the claims, and as defined herein.

What is claimed is:

1. A method of forming a tubular fabric bag with ends square to the length of the bag comprising:

feeding a flat sheet of fabric material along a predetermined path of travel, stopping the feeding of said sheet and cutting said sheet across a substantial portion of its width along a line that is spaced inwardly of each edge of the sheet, resuming feeding of the sheet along said path, then folding the edges of the sheet into a seam with the cut line precisely aligned on opposite sides of the seam so that the bag after its seam is sewn can be separated by snipping through the seam as well as any uncut material adjacent the seam to provide a bag with precisely square ends, and sewing the seam.

2. The method of claim 1 including the step of applying ink lines to the sheet while the sheet is moving and before the sheet is cut.

3. The method of claim 2 including the step of clamping the sheet on each side of the line of cut while the sheet is cut.

4. The method of claim 3 wherein the seam is formed by gradually moving the edges of the sheet from a substantially horizontal plane to a substantially vertical plane, and then converging both edges one towards the other.

5. The method of claim 1 wherein the ink lines are applied to the bottom of the sheet.

6. The method of claim 5 wherein said sheet is cut by a roller wheel cutter and including the step of activating said cutter only along a line spaced inwardly of the edges of the sheet.

7. A method of automatically forming a fabric filter bag tube comprising:

feeding a flat sheet of fabric material along a predetermined path;

frictionally gripping the sheet adjacent each side edge;

bringing said edges together while the sheet is moving;

overlapping said edges; and stitching through said overalpped edges to form a sewn seam.

8. The method of claim 7 wherein said step of gripping comprises, frictionally gripping said edges respectively between a rail and a belt moving along the rail.

9. The method of claim 7 further comprising folding each side edge upwardly with respect to the sheet.

10. The method of claim 7 wherein said step of bringing said edges together comprises, moving the edges horizontally toward each other while maintaining each edge upright.

11. The method of claim 10 further comprising engaging upright portions of the sheet adjacent each edge with each other with one edge vertical above the other edge.

12. The method of claim 11 wherein said step of overlapping the edges comprises overlapping and folding the edges to form a fell seam.

* * * * *